US005501375A

United States Patent [19]

Nilson

[11] Patent Number: 5,501,375

[45] Date of Patent: Mar. 26, 1996

[54] DISPENSER VALVE FOR DISPENSING A PRESSURIZED LIQUID

[75] Inventor: Billy Nilson, Mjolby, Sweden

[73] Assignee: Cenova Innovations & Produktions AB, Mjolby, Sweden

[21] Appl. No.: 242,543

[22] Filed: May 12, 1994

[51] Int. Cl.[6] ..... B65D 83/20

[52] U.S. Cl. ..... 222/402.13; 222/394; 222/464.1; 222/464.3; 222/528; 222/529

[58] Field of Search ..... 222/394, 402.1, 222/402.13, 402.15, 464, 511, 517, 635, 527, 528, 529, 537

[56] References Cited

U.S. PATENT DOCUMENTS

| | | | |
|---|---|---|---|
| 3,305,144 | 2/1967 | Beres et al. | 222/529 X |
| 3,539,081 | 7/1968 | Norton et al. | 222/517 X |
| 3,998,364 | 12/1976 | Hollander | 222/394 X |
| 4,664,257 | 5/1987 | Nilson | 206/219 |
| 4,666,064 | 5/1987 | Hoehn | 222/517 X |
| 5,022,565 | 6/1991 | Sturman et al. | 222/464 X |

FOREIGN PATENT DOCUMENTS

| | | | |
|---|---|---|---|
| 2414323 | 9/1979 | France | 222/529 |

*Primary Examiner*—Joseph A. Kaufman
*Attorney, Agent, or Firm*—Baker & Daniels

[57] ABSTRACT

A liquid dispensing valve including a flexible length of tubing. The tubing is bent along two parallel lines transverse to the axis of the tubing. The tubing is held in an actuator which, in a first position folds the tubing along the two parallel lines to close the tubing to the passage of fluid. In a second position the tubing is partially straightened whereby fluid can pass through the tubing.

5 Claims, 3 Drawing Sheets

DISPENSER VALVE FOR DISPENSING A PRESSURIZED LIQUID

BACKGROUND OF THE INVENTION

The present invention relates to a method and apparatus for dispensing a liquid from a container. More particularly the method and apparatus pertains to a method and apparatus for dispensing a liquid, such as a carbonated beverage, hair spray, soap, household cleaning fluid and the like from a pressurized container.

When a carbonated beverage such as a soft drink is sold in a large container, such as a conventional two liter plastic container, the open top of the container is generally sealed with a twist off cap so that the beverage remains pressurized within the container until the container is opened. Such containers are conventionally provided with screw tops which can be removed by the user whereby the pressure seal is broken. Unfortunately, when such bottles are opened, the container is depressurized and carbon dioxide gas is lost. This causes the carbonated beverage to go "flat". It is therefore desired to provide a dispenser for a beverage container wherein the bottle does not need to be opened while the liquid is being dispensed from the bottle whereby carbon dioxide pressure is retained in the container and the beverage retains its carbonation.

Liquids, other than carbonated beverages, have also been dispensed from containers by such means as hand operated pumps, and by the use of a pressurized gas and nozzles in the case of hair sprays and the like. Such dispensers have been unsatisfactory because of high cost, clogging of the nozzles by the liquid and inoperability due to complexity and failure of the dispensing structures.

It is therefore desired to provide a low cost simplified liquid dispenser which is easy to operate and which is not subject to the problems of the prior art dispensers.

SUMMARY OF THE INVENTION

The present invention comprises a method and apparatus for dispensing liquid from a pressurized container. The dispenser includes a length of tubing which includes two folds along substantially parallel, spaced apart, lines. The tubing is kept in its folded position by means of an actuator. The actuator includes a holder for retaining one segment of the tube in a stationary position. A second segment of the tube is selectively bent, by means of the actuator, into its folded position so that no liquid can pass through the tube when the tube is in that position. The open inlet end of the one segment of the tube is inserted into the liquid in the container. The open end of the second segment extends outside the container. The actuator can selectively cause the folded portion to be moved to a substantially straightened position wherein liquid can pass through the tube from its inlet to its outlet. Due to pressurization of the liquid in the container, liquid will be forced through the tube and will flow out of the container. A spring is provided to normally keep the tube in its folded position so that no liquid can escape from the container. Additionally a nozzle may be provided at the outlet of the tube for dispensing certain liquids such as hair spray and the like. The container may be pressurized by means of a source of pressurized gas. Gas may be injected into the tube and thence into the container.

It is an object of the present invention to provide a simplified dispenser for liquids.

It is a further object of the present invention to provide a dispenser for pressurized liquids such as carbonated beverages, soap, hair spray and the like.

It is another object of the present invention to provide a dispenser wherein gas may be injected into the liquid container through the dispenser mechanism.

BRIEF DESCRIPTION OF THE DRAWINGS

The above-mentioned and other features and objects of this invention, and the manner of attaining them, will become more apparent and the invention will be better understood by reference to the following description of the embodiments of the invention taken in conjunction with the accompanying drawings, wherein.

Figure 1:
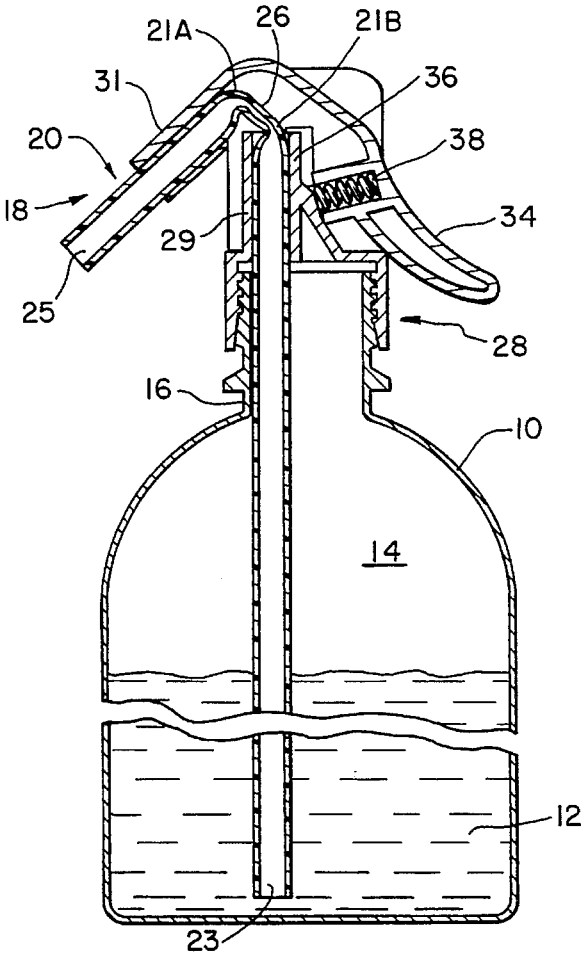
FIG. 1 is an elevational cross-sectional view of a liquid container and a dispenser mounted thereon wherein the dispenser is in its dispensing position.

Corresponding reference characters indicate corresponding parts throughout the several views of the drawings. The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Figure 3:
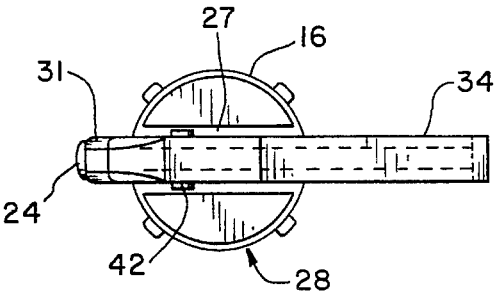
FIG. 3 is a top view of the dispenser shown in FIG. 2.
Figure 2:
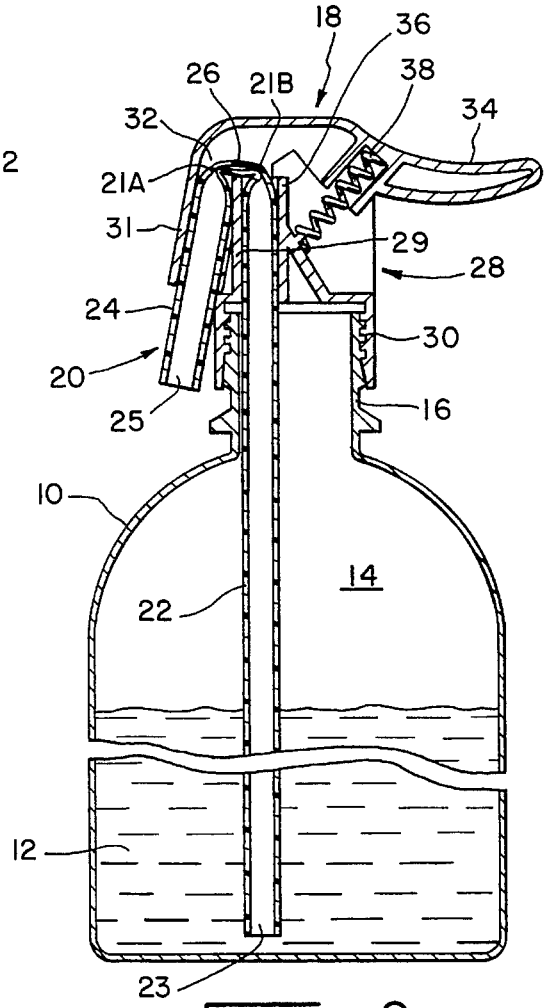
FIG. 2 is an elevational cross-sectional view of the dispenser of FIG. 1 with the dispenser in the non-dispensing position.

Referring now to the drawings and in particular to FIGS. 1–3, there is shown a container 10 which may be composed of any suitable material such as for instance plastic, glass, or metal. Liquid to be dispensed together with a pressurized gas is placed in the container. The gas should be suitable for the particular liquid to be dispensed and, in the case of a beverage, may be carbon dioxide. Alternatively, in the case of soap or hair spray the gas may be either air or an inert gas such as nitrogen. The gas pressure should be great enough to enable the dispenser to operate, as further discussed hereinbelow. It should be understood that the container should be strong enough to withstand the gas pressure within the container. The container may of course be collapsible in its empty state.

Container 10 includes a neck 16 which is provided with threads 30 as is conventional. An actuator 28 is provided with mating threads so that it can be threaded onto container 10. Actuator 28 may also be provided with a suitable gasket or the like to seal the actuator against the neck of the bottle 10. The actuator includes a flexible tube 20 which is bent or folded at two places 21A and 21B by means of parallel fold lines which run perpendicular to the lengthwise axis of tube 20. The two fold lines are separated by means of an intermediate section 26. The tube is thus divided into three sections namely an intake section 22 the open inlet end 23 of which is immersed in liquid 12, an intermediate section 26, and a dispensing section 24 whose open outlet end 25 is located outside the container. It should be noted that intermediate section 26 is flattened in comparison with the two tube sections 22 and 24. The two folds 21A and 21B are created by means of a folding member 29 which insures that when the tube is bent the two fold lines are formed. Further, in the non-dispensing position as shown in FIG. 2, the folds 21A and 21B substantially completely block the passage of fluid, both gas and liquid, from passing through the tube. However, in the dispensing position shown in FIG. 1, wherein the tube is partially straightened, the folds 21A and 21B are separated sufficiently to permit fluid to pass through the tube.

For further disclosure of the manner in which tube 20 is folded, reference should be had to U.S. Pat. No. 4,664,257 entitled "Method and Capsule for Storing and Mixing the Two Cooperative Basic Materials of Dental Amalgam and Method in Manufacturing the Capsule" issued May 12, 1987 to the inventor of the present application.

Thus tube 20, in its folded position as shown in FIG. 2 is in effect a valve which can be selectively opened or closed to selectively dispense liquid 12 from container 10. Dispensing is accomplished by means of an actuator 28 which, as pointed out hereinabove is threaded onto container 10. Actuator 28 includes a body 27 and a pivotable straightener member or holder 31 which is pivoted by means of a pivot pin 42 on body 27 and which defines a channel 32 in which dispensing section 24 of tube 20 is located. A trigger operator is provided together with a spring 38 to normally keep the straightener 31 in the non-dispensing position as shown in FIG. 2. In the dispensing position illustrated in FIG. 1 the trigger is depressed which compresses spring 38 whereby straightener 31 partly straightens tube 20. By partially straightening tube 20 and by partially unfolding folds 21A and 21B the tube is partially opened at folds 21A and 21B, thereby permitting pressurized liquid to enter inlet 23 and to be dispensed from outlet 25. Straightener member 31 may be any suitable means for straightening tube 20. In the particular embodiment shown the straightener member is a tubular member which forms a channel 32. Alternatively, straightener member 31 may be a ring or any other means for holding section 24 of tube 20 and for moving that section in such a way that the tube 20 is selectively partially straightened or folded to selectively permit passage of fluid therethrough or to block passage of fluid therethrough.

It should also be noted, by particular reference to FIGS. 1 and 2, that a folding member 29 is provided which, in the folded position of tube 20 as shown in FIG. 2 causes the folds to be compressed against folding member 29 by means of the action of straightener 31 so that the passage of fluid through tube 20 is completely blocked. Alternatively, in FIG. 1 it is seen that the intermediate section 26 of tube 20 is no longer in contact with folding member 29, whereby the pressure on folds 21A and 21B is relieved so that the tube is partially opened and fluid passage therethrough is made possible. As shown in FIGS. 1 and 2 folding member 29 can be made integral with guide member 36 which guides the upper portion of intake section 22 of tube 20 upwardly through actuator 28.

It should be noted that, only liquid will be forced through tube 20 whereby not all of the pressure in the container will be lost by the dispensing action. This is particularly advantageous in the case of a carbonated beverage as the loss of pressure will be slight if only small amounts of liquid are dispensed. Thus, the storage life of carbonated beverages is much increased by the invention as compared to prior art screw top bottles.

Figure 4:
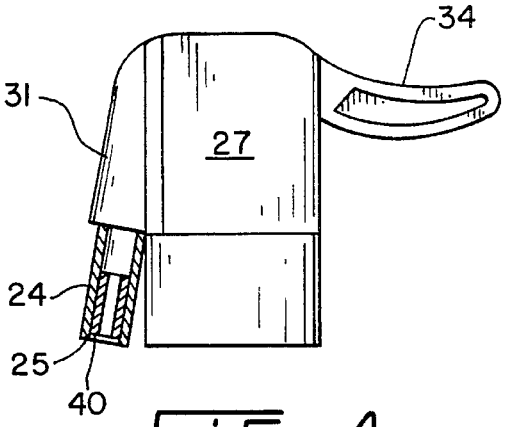
FIG. 4 is an elevational view of a dispenser for use in connection with hair spray, with the dispenser in the non-dispensing position.
Figure 5:
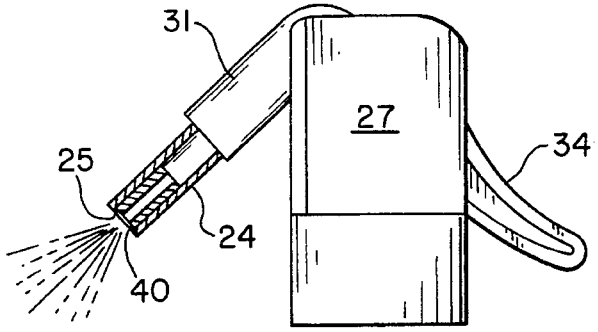
FIG. 5 is an elevational view of the dispenser of FIG. 4 with the dispenser in the dispensing position.
Figure 6:
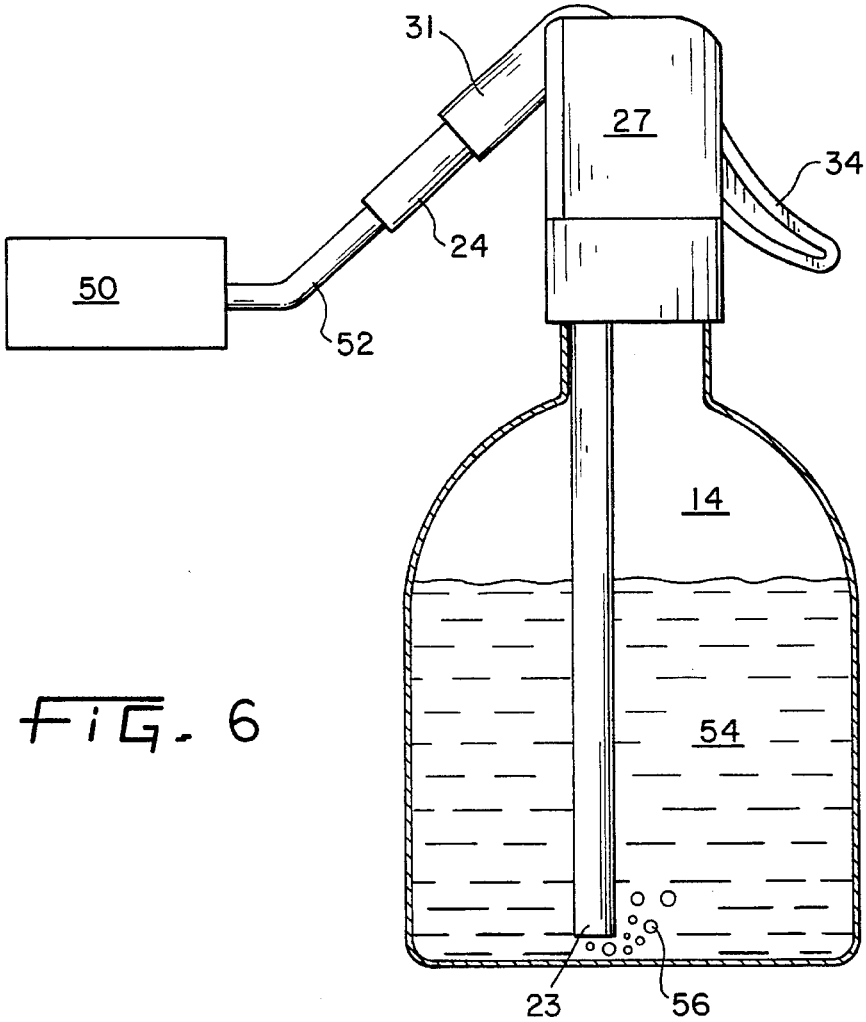
FIG. 6 is an elevational view of a container and dispenser wherein pressurized gas is being injected through the dispenser into the container.

Referring now to FIGS. 4–6 an embodiment of the invention is disclosed wherein hair spray is dispensed. As can be seen in FIG. 6, after the hair spray is placed in the container, and the tube 20 is partially straightened to allow passage of liquid or gas therethrough, the source of gas pressure is connected to the dispensing section whereby gas is admitted through tube 20 into container 14. The gas will exit inlet 23 as shown at 56. Thus it can be seen that if, during the dispensing operation, gas pressure is lost in the container, gas can easily be resupplied to the container. The same is true for carbonated beverages. Therefore, beverages can be reconstituted by simply supplying more carbon dioxide to a beverage container once the pressure in the container has been decreased beyond an acceptable level.

In the case of a hair spray dispenser, it can be seen that a nozzle may be provided in the outlet 25 of dispensing section 24 of tube 20. Such a nozzle can take any suitable form such as for instance shown in U.S. patent application Ser. No. 08/051,005 filed Apr. 21, 1993, now abandoned.

Figure 7:
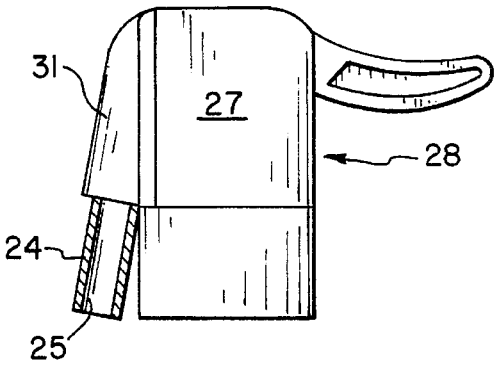
FIG. 7 is an elevational view of a soap dispenser with the dispenser in the non-dispensing position.
Figure 8:
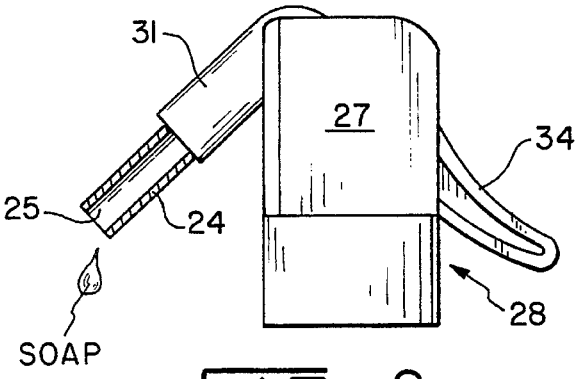
FIG. 8 is an elevational view of the dispenser of FIG. 7 with the dispenser in the dispensing position.
Figure 9:
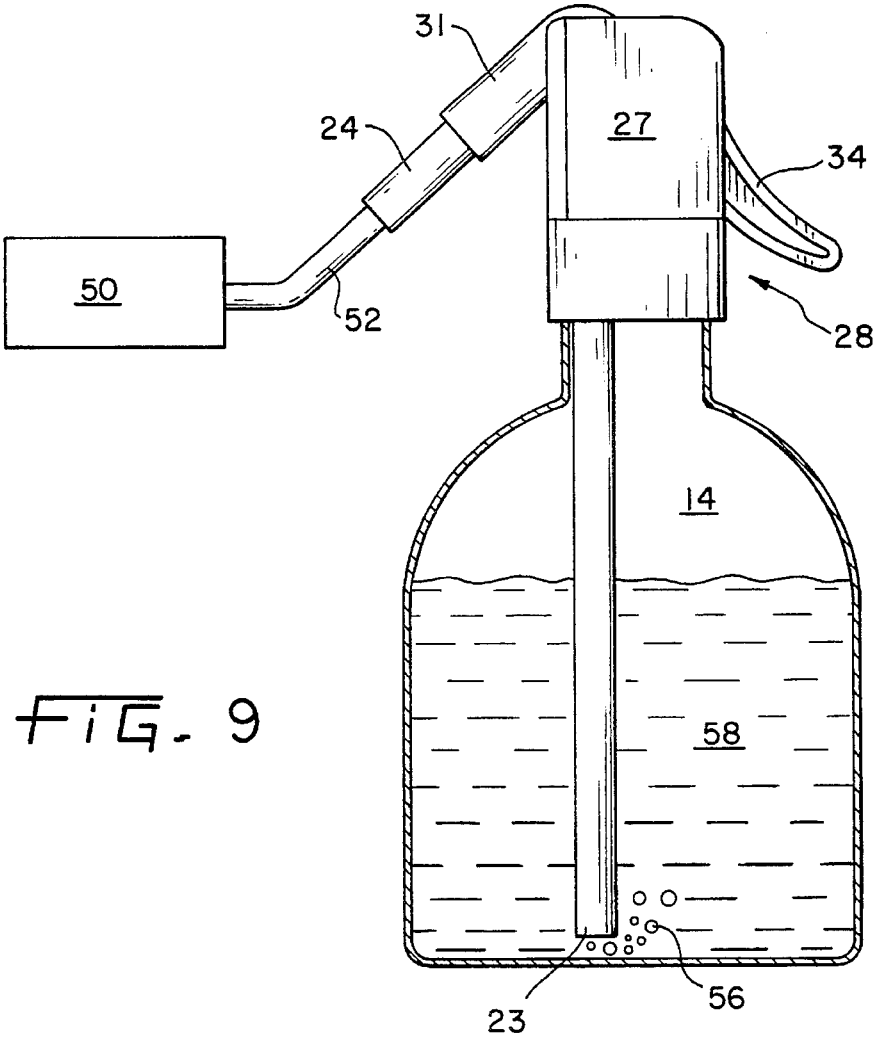
FIG. 9 is an elevational view of a soap dispenser wherein pressurized gas is being injected through the dispenser into the container.

FIGS. 7–9 disclose a soap container wherein gas may also be injected into the container to pressurize the liquid and to aid in the dispensing operation. In the case of a soap dispenser no special nozzle need be provided in outlet 25.

While in the disclosed embodiments only beverages, hair spray and liquid soap have been disclosed as suitable for the application of the dispenser mechanism, it should be noted that numerous other liquids would be suitable for dispensing with the apparatus as disclosed herein. Thus, the dispenser can be used with any household or industrial liquid which must be kept in a container and dispensed thereafter. Such liquids may be cleaning fluids, polishes, paints and the like.

While in the disclosed embodiments there has been disclosed an operating gas for generating pressure in a container, other means for generating pressure in the container could also be used. For instance a collapsible container could be used so that, upon collapsing the container, pressure could be generated in the container for dispensing liquid in the container. Alternatively, other suitable means for pressurizing the liquid could be used.

While this invention has been described as having a preferred design, it will be understood that it is capable of further modification. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A dispenser valve for dispensing a liquid from a container wherein the container contains a liquid to be dispensed and a pressurized gas, said dispensing valve comprising:

a length of flexible tubing, said tubing divided into three segments by two folds along two substantially parallel lines arranged perpendicularly to the axis of said tubing, said folds separated by a section of said tubing, a first said segment movable relative to a second said segment, one end of said tubing adapted to be immersed in said liquid;

a straightener for selectively retaining said length of tubing in a folded condition to block passage of fluid therethrough and for selectively moving said first segment relative to said second segment to permit fluid to pass therethrough, whereby liquid is selectively dispensed from a said container.

2. The dispenser valve according to claim 1 including a folding member for retaining the folds in said tubing when the tubing is in said folded condition.

3. The dispenser valve according to claim 1 wherein said straightener includes a pivoting member for selectively guiding said tube into said folded condition and said straightened condition.

4. A dispenser valve for a liquid comprising:

a body including a connector for connecting to a corresponding connector on a bottle;

a moveable member pivotally connected to said body and including an actuator;

a spring for urging said moveable member into a first position;

a flexible tube including an inlet, an outlet and a folded section located intermediate said inlet and outlet and defined by two spaced apart parallel fold lines arranged transverse to the longitudinal axis of said tube, said folded section defining first and second segments of said tubing which are relatively movable with respect to each other, said tube connected to said moveable member to be selectively folded to block passage of fluid therethrough and unfolded to relatively move said first segment with respect to said second segment to thereby permit the passage of fluid therethrough.

5. The dispenser valve according to claim 4 and including a folding member arranged to contact said tube in said folded state to ensure that said tube is substantially completely closed off at said fold lines.

* * * * *